United States Patent [19]

Nufer

[11] 4,416,208

[45] Nov. 22, 1983

[54] AUXILIARY DEVICE FOR A SEWING MACHINE

[75] Inventor: Karl Nufer, Steckborn, Switzerland

[73] Assignee: Fritz Gegauf Ag Bernina-Naehmaschinenfabrik, Steckborn, Switzerland

[21] Appl. No.: 268,138

[22] Filed: May 29, 1981

[30] Foreign Application Priority Data

Aug. 26, 1980 [CH] Switzerland ..... 6409/80

[51] Int. Cl.[3] ..... D05B 29/12

[52] U.S. Cl. ..... 112/240; 112/121.11

[58] Field of Search ..... 112/235, 240, 275, 277, 112/158 E, 158 B, 158 F, 121.11

[56] References Cited

U.S. PATENT DOCUMENTS

| | | | |
|---|---|---|---|
| Re. 29,952 | 4/1979 | Odermann et al. | 112/158 E |
| 2,929,344 | 3/1960 | Theenhausen et al. . | |
| 3,926,133 | 12/1975 | Herron et al. . | |
| 4,079,683 | 3/1978 | Hanyu et al. . | |
| 4,117,791 | 10/1978 | Current et al. . | |
| 4,233,919 | 11/1980 | Takahashi et al. | 112/275 X |
| 4,236,471 | 12/1980 | Okamato et al. | 112/240 |
| 4,274,348 | 6/1981 | Kato | 112/158 E |
| 4,289,084 | 9/1981 | Takenoya et al. | 112/235 X |
| 4,292,905 | 10/1981 | Widmer . | |

FOREIGN PATENT DOCUMENTS

| | | |
|---|---|---|
| 16724 | 10/1980 | European Pat. Off. . |
| 2903030 | 10/1978 | Fed. Rep. of Germany . |
| 369009 | 6/1963 | Switzerland . |
| 2015596 | 9/1979 | United Kingdom . |
| 2016535 | 9/1979 | United Kingdom . |

*Primary Examiner*—Peter P. Nerbun

*Attorney, Agent, or Firm*—Wender, Murase & White

[57] ABSTRACT

An auxiliary device for sewing machines comprises tappets and switches in the coupling parts of the presser foot shaft. The tappets are arranged in accordance with a determined code and they activate a combination of the switches. The switches are connected to an electronic circuit in which the coded information relative to the presser foot is compared with information characterizing the set up of the machine for a desired sewing operation. A display is activated for indicating if both sets of information coincide or do not coincide with each other so that the user knows if the correct presser foot is inserted.

7 Claims, 4 Drawing Figures

AUXILIARY DEVICE FOR A SEWING MACHINE

BACKGROUND OF THE INVENTION

The present invention relates to an auxiliary device for a sewing machine for indicating the attachment of an interchangeable presser foot not corresponding to a determined machine set up for a sewing operation. The presser feet of a sewing machine are generally interchangeably attached to a shaft or directly to the presser bar of the machine and are accessories configured and used for performing determined sewing operations. The number of the presser feet associated to a sewing machine varies in accordance with the type and the equipment of the machine and it is often really difficult to distinguish the different presser feet from each other. For this reason, various precautionary indicators such as ciphers, symbols, colour codes and the like have been utilized in order to facilitate the distinction between them. However, should the user nevertheless attach a wrong presser foot to the machine, no precautionary measures are taken in order to call her attention to such an error.

The object of the present invention is to provide means which indicates and/or prevents the insertion of a wrong presser foot or prevents the starting of the machine when damages (breaking of the needle, injury of the presser foot) are likely to occur if a wrong presser foot is inserted.

SUMMARY OF THE INVENTION

In accordance with the present invention, the sewing machine comprises means for identifying the presser foot while said presser foot is being inserted and means provided to the frame of said machine which responds differently to the insertion of a presser foot not corresponding to the set up than to the insertion of a properly corresponding presser foot.

This makes it possible to indicate optically and/or acoustically that a wrong presser foot is inserted, to block the full insertion or fastening of a wrong presser foot or to interrupt the current supply to the motor while a wrong presser foot is being inserted.

The invention will be described further by way of example with reference to the accompanying drawings.

DESCRIPTION OF THE PREFERRED EMBODIMENT

Figure 1:
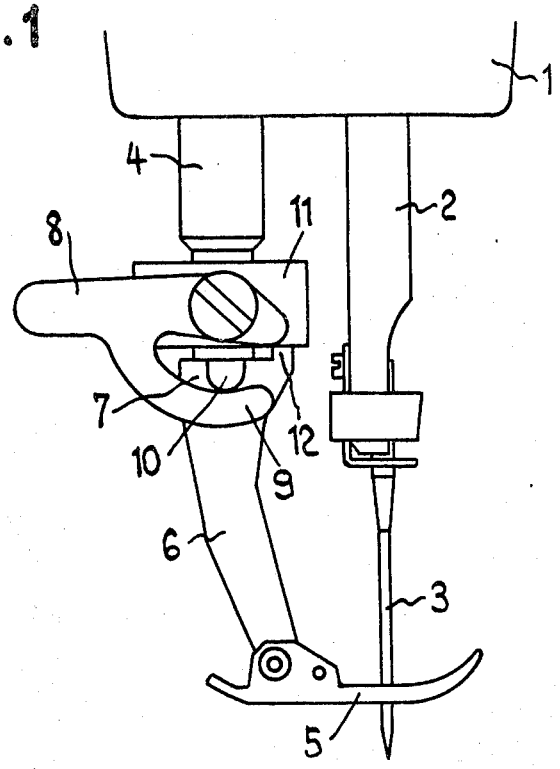
FIG. 1 shows a partial-back-view of a sewing machine.

A needle bar 2 with the needle 3 is mounted to a guide in the frame 1 of the sewing machine for vertical displacement. A presser bar 4 is also mounted in the frame 1 at the side of the needle bar. The presser foot 5 with its shaft 6 and a coupling part 7 is fastened to the presser bar 4 and secured to the coupling part 11 of a presser bar by means of a slewable lever 8 which has a projection 9 for engagement with the lower side of a tappet 10 of the presser foot. By turning the lever 8 in an upwardly direction, the presser foot is released and may be removed from the coupling part 11 of the presser bar 4 for replacement by another presser foot corresponding to a preselected set up of the machine.

Figures 3, 4:
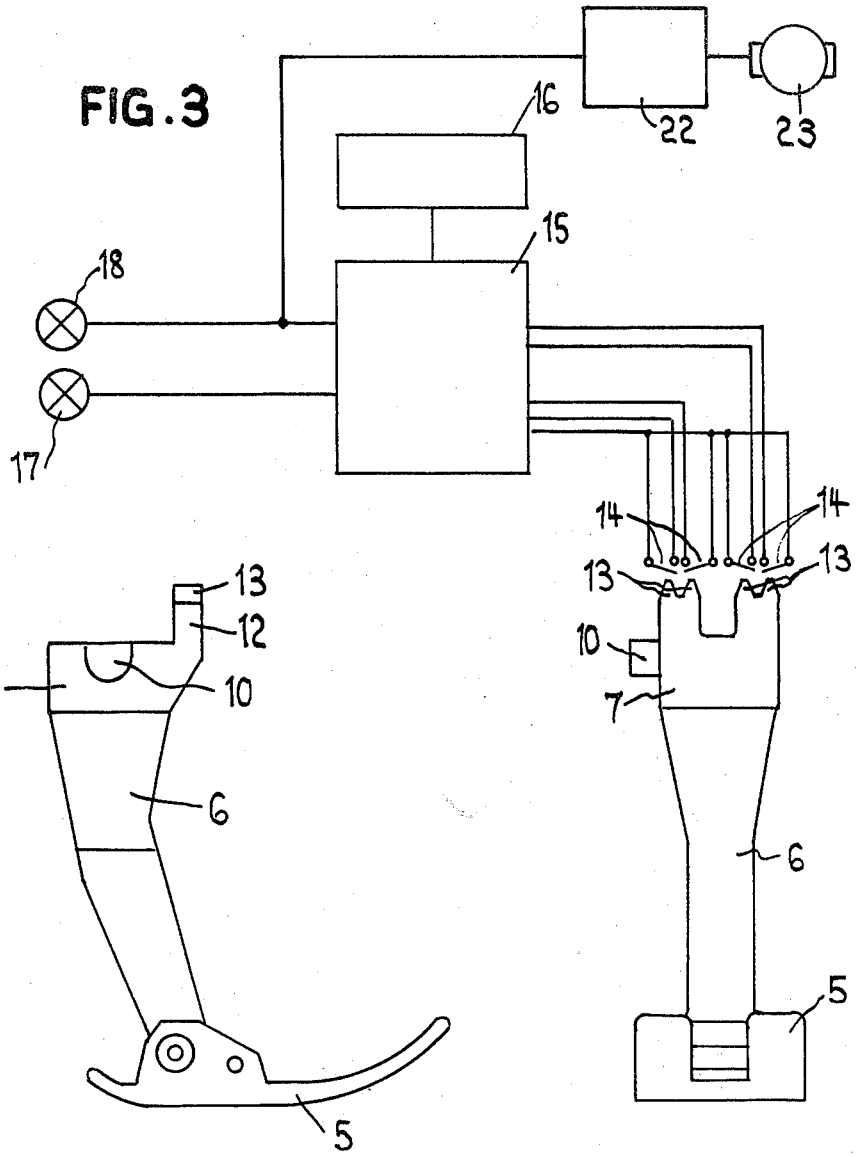
FIG. 3 shows a schematic representation of the auxiliary device.
FIG. 4 shows a side view of the presser foot.

As shown in FIG. 3, the coupling part 7 of the presser foot 5 comprises at one side thereof a rib 12 having tappets 13 at least on four determined locations. Switches 14, each one of them corresponding to one of the tappets 13 are arranged opposite to the tappets in the coupling part 11 of the presser bar 4. As shown in FIG. 3, the switches are normally open. They are closed by the respective corresponding tappets 13 when the coupling part 7 of the presser foot 5 is fully inserted in the coupling part 11 of the presser bar 4. In the described embodiment all of the locations of the rib 12 are provided with tappets 13. However, any other possible combination of tappets 13 may also be used which results in up to 16 different presser feet, each having individual associated combinations of tappets. By providing e.g., 5 locations for the tappets, the number of possible combinations increases to 25, and so on.

All switches 14 are connected with an electronic driving circuit 15, for example a microprocessor. An input device 16 permits introduction into the driving circuit 15 of coded information corresponding to a determined set up and sewing operation. The comparison performed by the driving circuit 15 between the coded information introduced by the input device 16 and the information delivered by the switches 14 permits it to determine if the inserted presser foot corresponds or not to the set up of the sewing machine. Depending on the result of the comparison, either a green display lamp 17 or a red display lamp 18 is switched on by the outputs of the driving circuit 15. These lamps 17 and 18 are mounted on the housing of the sewing machine over the presser bar 4. The green lamp is activated when the right presser foot is inserted while the red lamp is activated when a wrong presser foot is inserted. The user may then remove the wrong presser foot and insert the right one. The user is alerted that the machine is out of working order, that is, the red warning lamp 18 is always activated either when a wrong presser foot not corresponding to the desired sewing operation is inserted or when the machine is not correctly set up for performing the desired sewing operation. It is in any case possible to undertake correcting steps until the green lamp illuminates for indicating that the sewing operation, and accordingly the adjusted set up of the machine, corresponds to the selected presser foot. Due to the fact that the red lamp 18 is disposed over the green lamp 17, color blind operators will interpretate the display correctly.

As indicated in FIG. 3, the output of the driving circuit 15 which drives the red lamp 18 is also connected to a relay 22 which delivers the driving current to the motor 23 of the sewing machine. The relay 22 is activated simultaneously with the red lamp 18. This stops the motor when a discrepancy exists between an inserted presser foot and the set up of the machine.

Figure 2:
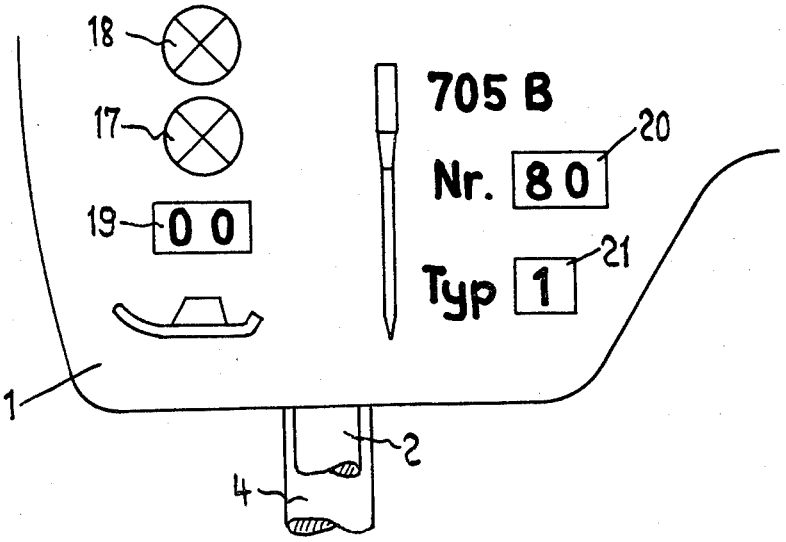
FIG. 2 shows a partial-side view of the sewing machine of FIG. 1.

The above-described auxiliary device is used preferably with a sewing machine being already equipped with electronic means for displaying indications relative to the correct set up and equipments, and accordingly relative to the conditions which must be fullfilled for performing a desired sewing operation. Such a sewing machine is described in the U.S. patent application Ser. No. 154,337. As indicated in FIG. 2, symbols of the needle and accordingly the presser foot are provided over the needle bar 2 and thus over the presser bar 4.

Display fields 19, 20 and 21 are associated to these symbols for indicating the required ciphers of the correct needles, and their corresponding presser feet. These ciphers are also indicated on the corresponding presser feet which greatly facilitate the choice of the proper presser foot. The above-described auxiliary device indicates mistakes as they are occurring in order to prevent undesirable sewing operations or injuries of the needle and/or the presser foot.

In the embodiment described above an optical display is exclusively provided for indicating if a right or a wrong presser foot is inserted. However, it would be possible to provide also an acoustic alarm when a wrong presser foot is being inserted in order to further reinforce the attention of the user upon the arising error. Moreover, it would be possible to provide also a blocking device which would either prevent the definitive, full insertion or the fastening of the presser foot or block the drive of the sewing machine when a wrong presser foot is inserted. In the described embodiment, an electromechanical blocking device could be provided for slewing downwards the lever 8 in order to prevent the definitive attachment of the presser foot to the presser bar.

Instead of the described means for identifying the inserted presser foot, other adequate sensors like inductive, capacitive or piezoelectric transducers may be used with corresponding other senders provided on the coupling part 7 of the presser foot to which the sensors in the coupling part of the presser bar would respond.

I claim:

1. In a sewing machine of the type having variable machine set ups corresponding to different machine sewing operations and having interchangeable presser feet corresponding to specific set ups, an auxiliary device for indicating the attachment of a presser foot not corresponding to a determined set up, said device comprising:

first means for delivering information corresponding to the type of presser foot in response to presser foot insertion into the machine;

second means for delivering information corresponding to the set up of the machine;

electronic means connected to said first and second means for receipt and comparison of the information delivered by said first and second means and for determination if the inserted presser foot is of the type corresponding to the set up; and indicating means connected to said electronic means for indicating to a machine operator if the presser foot corresponds to the machine set up.

2. The auxiliary device according to claim 1, the sewing machine further of the type having a presser bar with a bar coupling part and the presser feet each of the type having a foot coupling part adapted for cooperation with the bar coupling part for insertion of a desired foot into the machine, wherein said first means comprises sensors mounted in said bar coupling part and senders provided on each foot coupling part, said sensors being actuated by said senders on the presser foot when that foot is inserted into the machine.

3. The auxiliary device according to claim 2, wherein said sensors are switches and said senders are corresponding tappets disposed on a rib of each of said feet coupling parts.

4. The auxiliary device according to claim 1, wherein said electronic means is a microprocessor for receiving the information corresponding to a presser foot delivered by said first means and the information corresponding to the machine set up delivered by said second means, such that said microprocessor can determine if the inserted presser foot is of the type corresponding to the set up and activating said indicating means.

5. The auxiliary device according to claim 4, wherein said indicating means is a green lamp that is activated when the properly corresponding presser foot is inserted and a red lamp activated when an improperly corresponding wrong presser foot is inserted, said red lamp being disposed over said green lamp in a housing of the machine, above said presser bar.

6. The auxiliary device according to claim 1, further comprising means for blocking the sewing machine while a wrong presser foot is inserted in the machine, said blocking means being controlled by said electronic means.

7. The auxiliary device according to claim 6, wherein said blocking means is a relay for delivering driving current to a motor of said sewing machine such that the relay does not allow current delivery to the motor while a wrong presser foot is inserted in the machine.

* * * * *